US006434763B2

(12) United States Patent
Kawakami

(10) Patent No.: US 6,434,763 B2
(45) Date of Patent: Aug. 20, 2002

(54) SEAT SUPPORTING TABLE FOR A BARBER OR BEAUTY CHAIR AND HAIR WASHER WITH THE SEAT SUPPORTING TABLE

(75) Inventor: Toshiaki Kawakami, Hiji-machi (JP)

(73) Assignee: Oohiro Works, Ltd. (JP)

( * ) Notice: Subject to any disclaimer, the term of this patent is extended or adjusted under 35 U.S.C. 154(b) by 0 days.

(21) Appl. No.: 09/901,359

(22) Filed: Jul. 9, 2001

(30) Foreign Application Priority Data

Jul. 7, 2000 (JP) ..... 2000-207452

(51) Int. Cl.[7] ..... A45D 44/00
(52) U.S. Cl. ..... 4/523; 4/519; 297/344.1
(58) Field of Search ..... 4/515, 519, 523; 297/344.1, 344.11, 341

(56) References Cited

U.S. PATENT DOCUMENTS 3,810,673 A * 5/1974 Shoji
4,840,000 A * 6/1989 Grines
4,918,767 A * 4/1990 Benting
5,468,050 A * 11/1995 Hall et al.
5,620,230 A * 4/1997 Wu
5,899,428 A * 5/1999 Gauger
6,089,665 A * 7/2000 Andrigo
6,170,096 B1 * 1/2001 Rasmussen
6,230,345 B1 * 5/2001 Borrero et al.

* cited by examiner

*Primary Examiner*—Charles R. Eloshway
(74) *Attorney, Agent, or Firm*—Wall Marjama & Bilinski LLP

(57) ABSTRACT

A seat supporting table for a barber of beauty chair which can slide a barber or beauty chair even when the barber or beauty chair is provided with no sliding function. A sliding plate, to which the barber or beauty chair is attached, is slid forward and backward to a desired position along a guide rail for guiding a slide of the sliding plate. A sliding power controlling bolt for controlling a sliding power required for sliding the sliding plate is also provided and a slider controls the sliding of the sliding plate.

3 Claims, 4 Drawing Sheets

SEAT SUPPORTING TABLE FOR A BARBER OR BEAUTY CHAIR AND HAIR WASHER WITH THE SEAT SUPPORTING TABLE

FIELD OF THE INVENTION

The present invention relates to a seat supporting table for a barber or beauty chair, to which a barber or beauty chair used chiefly at a barbershop or a beauty salon is attached.

BACKGROUND OF THE INVENTION

Conventionally, when a hair washing is performed at a barber or beauty chair, a person for performing a hair washing makes a person to be washed sit on a seat of a barber or beauty chair with his back against a hair washer, and tilts a seat back of the barber or beauty chair, and then performs a hair washing with the person to be washed lying with his neck on a neck receiving part of the hair washer. At this time, when a person to be washed to be seated on the chair of the barber or beauty chair is tall, the seat back is tilted with the person to be washed being seated on the seat, which results in that a neck part of the person to be washed is not appropriately received by the neck receiving part, and further the person to be washed feels uncomfortable due to the receiving angle. As a measure for solving the problems, there exists a barber or beauty chair having a seat part provided with a function of sliding forward. According to the barber or beauty chair, when the person to be washed is tall, the barber or beauty chair is slid so that the person to be washed does not feel uncomfortable.

However, when the seat of the barber or beauty chair is exchanged with a new seat because of the dirtiness and the design change due to remodeling of a shop, in case where a barber or beauty chair having a seat provided with a sliding function is employed as conventionally, the seat of the barber or beauty chair might be exchanged with a seat having no sliding function, due to the design. In the above case, the barber or beauty chair cannot be slid.

SUMMARY OF THE INVENTION

The present invention is made to solve the above-mentioned problems, and it is an object of the present invention to provide a seat supporting table for a barber or beauty salon, which can slide a barber or beauty chair even when a seat of a barber or beauty chair is provided with no sliding function, and a hair washer provided with the seat supporting table.

According to a first aspect of the present invention, a seat supporting table, to which a barber or beauty chair can be detachably attached, wherein the seat supporting table is provided with a sliding part which slides forward and backward toward a seat back face of the barber or beauty chair to be attached, and the sliding part is provided with an attaching part for attaching the barber or beauty chair.

Therefore, even when the barber or beauty chair is provided with no sliding function, it is possible to slide such a barber or beauty chair.

According to a second aspect of the present invention, the seat supporting table for a barber or beauty chair described in claim 1, wherein the sliding part is slid to a desired position along a guide rail for guiding a slide of the sliding part, and a sliding power controlling part for controlling sliding power required for sliding the sliding part is provided.

Therefore, the sliding power required for sliding the barber or beauty chair can be controlled according to the sliding power controlling part.

According to a third aspect of the present invention, the seat supporting table for a barber or beauty chair described in the first aspect or the second aspect, wherein the attaching part for attaching the barber or beauty chair is a projection to be engaged with an engaging part provided on a rear face of the barber or beauty chair.

Therefore, the barber or beauty chair can be easily attached to/removed from the seat supporting table for the barber or beauty chair.

According to a fourth aspect of the present invention, a hair washer comprises a ball part provided with a neck receiving part for receiving a neck part of a person to be washed, a leg part for supporting the ball part, and a seat supporting table supporting arm, one end of which is fixed to the leg part, and the other end of which is provided with a seat supporting table, to which a barber or beauty chair can be detachably attached, wherein the seat supporting table is provided with a sliding part which slides forward and backward toward a seat back of the barber or beauty chair to be attached, and the sliding part is provided with an attaching part for attaching the barber or beauty chair.

Therefore, even when the barber or beauty chair is provided with no sliding function, the barber or beauty chair can be slid forward and backward. Further, the person to be washed feels less uncomfortable on his neck during shampooed, regard less of his height.

According to a fifth aspect of the present invention, the hair washer with the seat supporting table for a barber or beauty chair described in the fourth aspect, wherein the sliding part is slid to a desired position along a guide rail for guiding a slide of the sliding part, and comprises a sliding power controlling part for controlling sliding power required for sliding the sliding part.

Therefore, it is possible to provide a hair washer with the seat supporting table for a barber or beauty chair, in which the sliding power required for sliding the barber or beauty chair can be controlled according to the sliding power controlling part.

According to a sixth aspect of the present invention, the hair washer with a seat supporting table for the barber or beauty chair described in the fourth aspect or the fifth aspect, wherein the attaching part for attaching the barber or beauty chair is a projection to be engaged with an engaging part provided on a rear face of the barber or beauty chair.

Therefore, it is possible to provide a hair washer with the seat supporting table for a barber or beauty chair, in which the barber or beauty chair can be freely attached to/removed from the seat supporting table for a barber or beauty chair.

DETAILED DESCRIPTION OF THE PREFERRED EMBODIMENTS

Embodiment 1

A first embodiment described in claims 1 through 6 will be described with referring to FIGS. 1 to 4.

Figure 2:
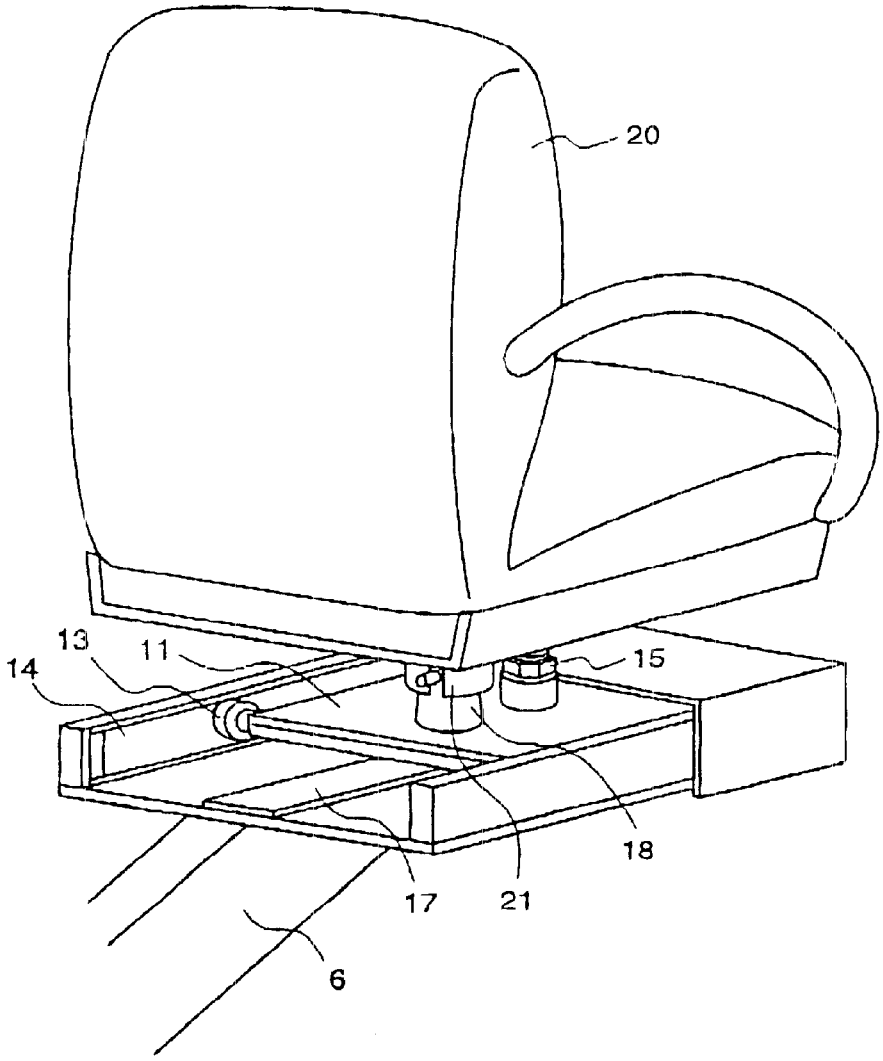
FIG. 2 is a perspective view illustrating a state in which a barber or beauty chair is attached to a seat supporting table for a barber or beauty chair according to the first embodiment of the present invention.
Figure 3A:
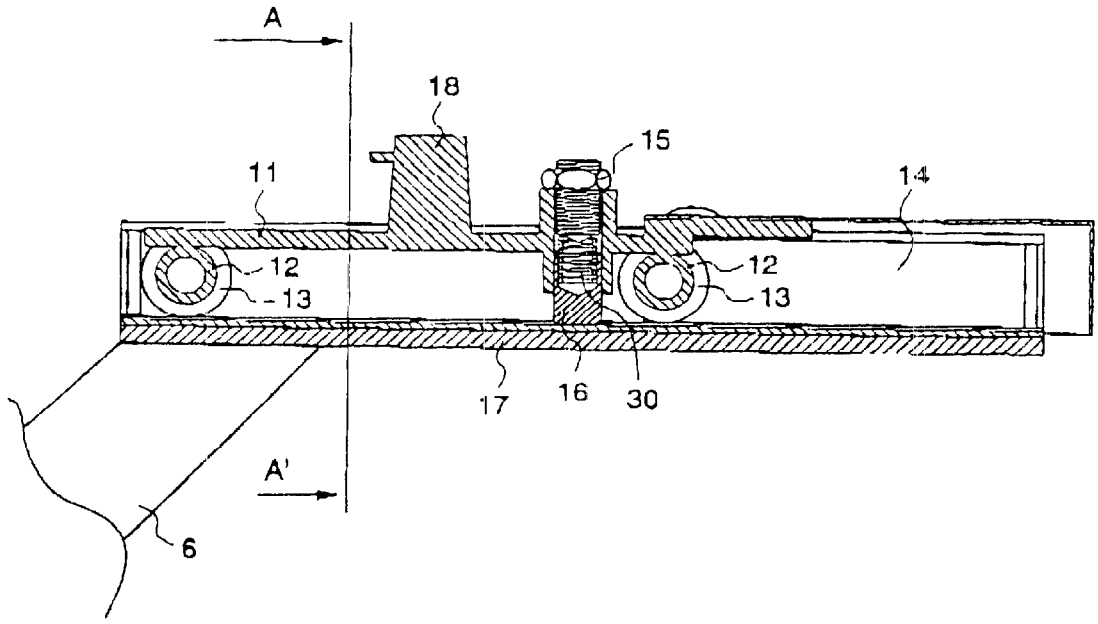
FIG. 3 is a cross sectional view illustrating a structure of a seat supporting table for a barber or beauty chair according to the first embodiment of the present invention.
Figure 3B:
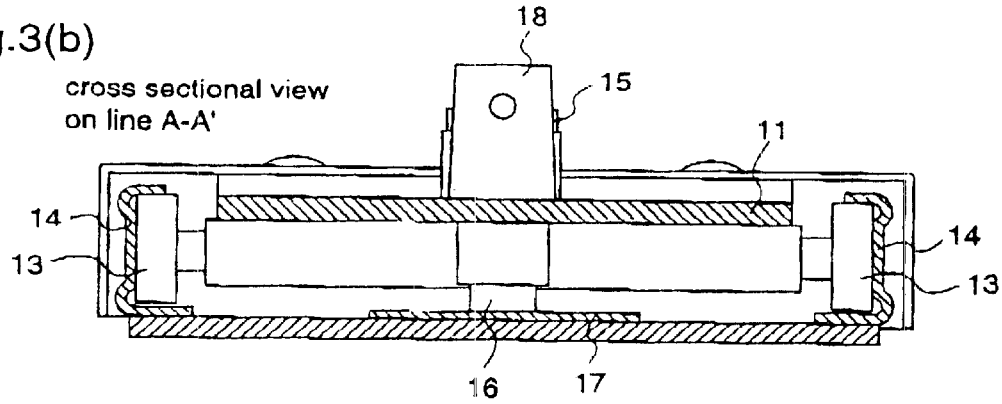

Initially, structures of a hair washer with a seat supporting table for a barber or beauty chair and the seat supporting table for a barber or beauty chair according to a first embodiment of the present invention will be described with referring to FIGS. 1 to 3.

Figure 1:
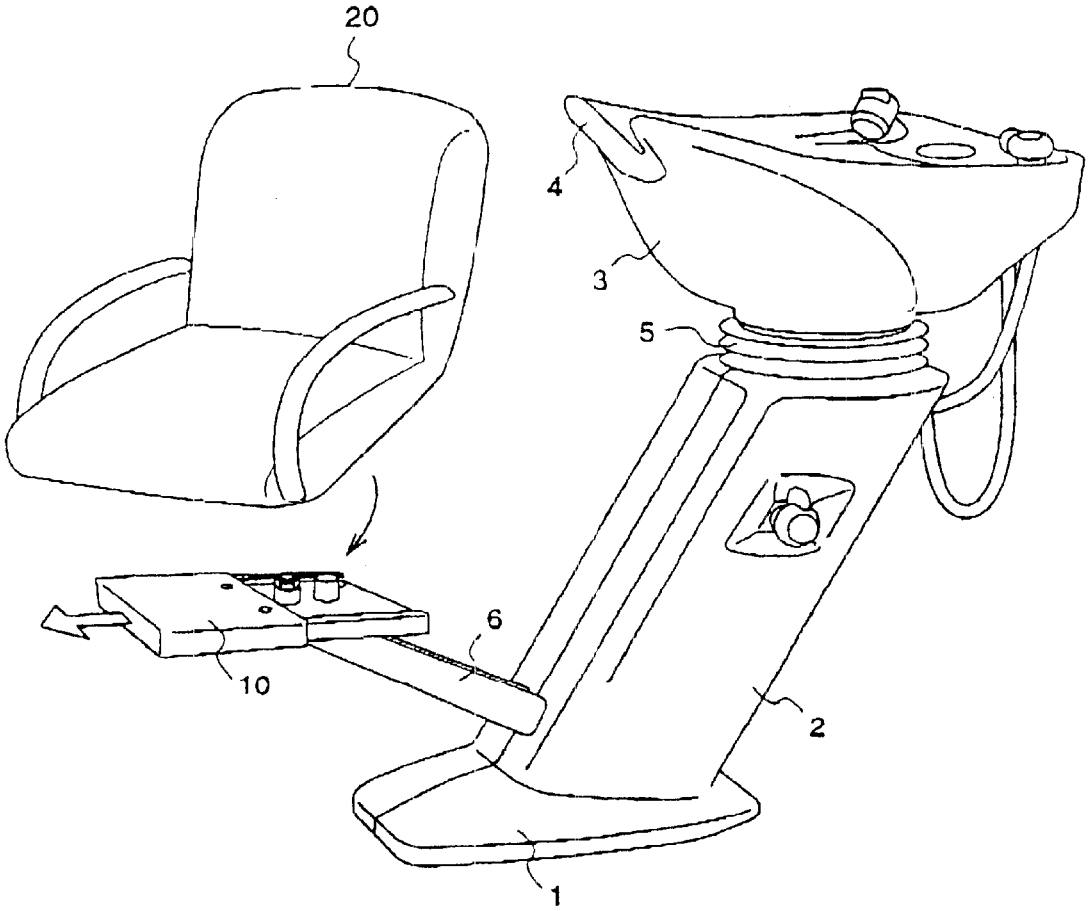
FIG. 1 is a perspective view illustrating an external appearance of a hair washer with a seat supporting table for a barber or beauty chair according to a first embodiment of the present invention.

FIG. 1 is a perspective view illustrating an external appearance of a hair washer with a seat supporting table for a barber or beauty chair according to the first embodiment of the present invention. FIG. 2 is a perspective view illustrating a state in which a barber or beauty chair is attached to a seat supporting table 10 for a barber or beauty chair according to the first embodiment of the present invention. FIG. 3(*a*) is a cross sectional view illustrating a structure of the seat supporting table 10 for a barber or beauty chair according to the first embodiment of the present invention. FIG. 3(*b*) is a cross sectional view on line A–A' of the view illustrated in FIG. 3(*a*).

In FIG. 1, reference numeral 1 designates a base table part which is placed with fixed on a floor face. Reference numeral 3 designates a ball part, at which a hair washer performs shampooing. Reference numeral 4 designates a neck receiving part, on which a person to be washed places his neck at shampooed. Reference numeral 2 designates a leg part which extends upwardly so as to support the ball part 3. Reference numeral 5 designates a connection part for attaching the ball part 3 to the leg part 2, which is provided between the leg part 2 and the ball part 3. Reference numeral 10 designates a seat supporting table, to which a barber or beauty chair is attached. Reference numeral 6 designates a seat supporting table supporting arm, one end of which is provided with the seat supporting table 10, and the other end of which is fixed to the leg part 2. Further, as shown in FIG. 2, the barber or beauty chair 20, on which the person to be washed is seated, and the seat back of which can be freely tilted is attached to the seat supporting table 10. The barber or beauty chair 20 is provided with an engaging part 21 to be engaged with an attaching part 18. The engaging part 21 is engaged with the attaching part 18 of the seat supporting table 10, whereby the barber or beauty chair 20 is fixed to the seat supporting table 10.

A structure of the seat supporting table 10 will be described in details with referring to FIGS. 3(*a*) and 3(*b*).

A sliding plate 11 (a sliding part) is composed of an attaching part 18 for attaching the barber or beauty chair 20, a connecting part 12 for connecting rollers 13 for sliding the sliding plate 11 to the sliding part 11 with each other, and a sliding power controlling part for controlling sliding power required for sliding the sliding plate 11, when the sliding plate 11 slides along a guide rail 14.

Further, the guide rail 14 extends perpendicularly to a seat back face of the barber or beauty chair attached to the seat supporting table 10, to be served as a track when the rollers 13 slide.

Further, the sliding power controlling part is composed of a sliding power controlling bolt 15, a spring 30, and a slider 16. The sliding power controlling bolt 15 determines a position of an upper end of the spring 30 for pressing down the slider 16 to the sliding plate 17 stuck to the seat supporting table 10, thereby controlling sliding power required for sliding the sliding plate 11.

A sliding motion in the seat supporting table 10 for a barber or beauty chair accompanied by performing a shampoo with employing a hair washer with the seat supporting table for the barber or beauty chair according to the first embodiment will be described with referring to FIG. 4.

Figure 4A:
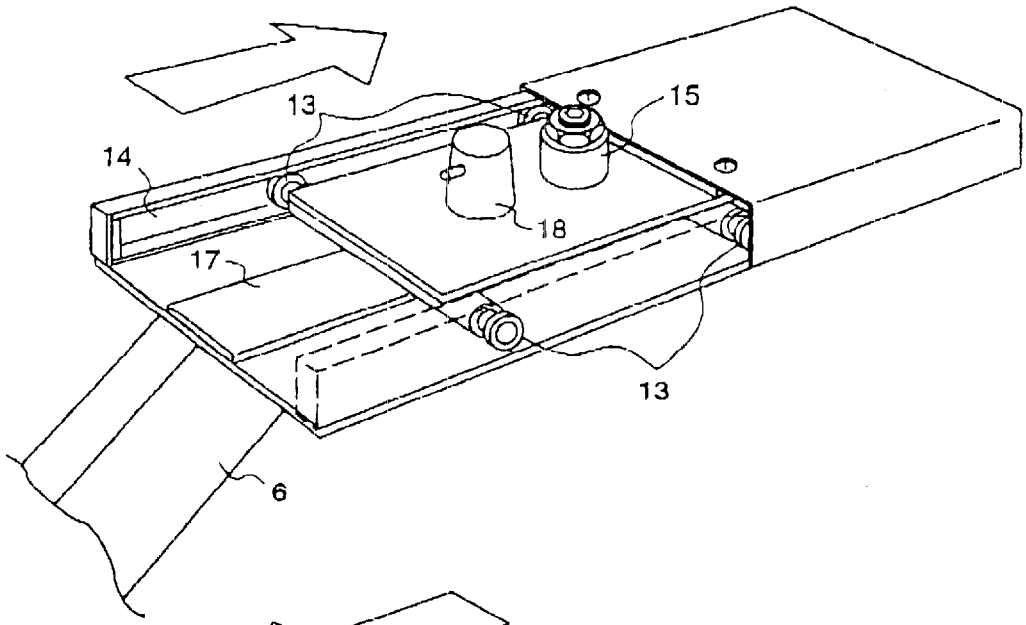
FIG. 4 is a perspective view illustrating a moving state of a seat supporting table for a barber or beauty chair according to the first embodiment of the present invention.
Figure 4B:
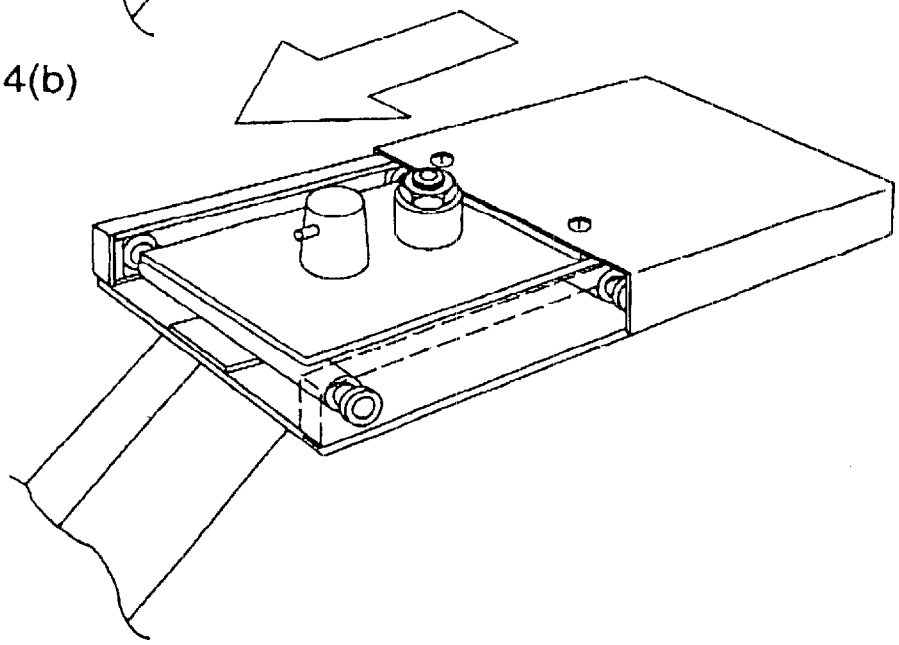

FIG. 4(*a*) is a view illustrating that the seat supporting table 10 for a barber or beauty chair according to the embodiment 1 is slid. FIG. 4(*b*) is a view illustrating the seat supporting table 10 is slid to the original position from the slid position illustrated in FIG. 4(*a*). Further, in FIG. 4, the same reference numerals and characters as those in FIG. 3 designate the same or corresponding parts. So, the descriptions will be omitted.

Initially, the hair washer with the seat supporting table for a barber or beauty chair according to the first embodiment is in a stored state illustrated in FIG. 4(*b*).

The person for performing a hair washing (not shown) makes a person to be washed (not shown) sit on the barber or beauty chair 20 fixed to the attaching part 18 of the sliding plate 11 of the seat supporting table 10, and tilts the seat back of the barber or beauty chair 20 so that the person to be washed lies down with his neck on the neck receiving part 4 of the ball part 3.

At this timing, when the person to be washed is tall, the person for performing a hair washing pushes the seat back of the barber or beauty chair 20 in a opposite direction from the hair washer. Therefore, as illustrated in FIG. 4(*a*), the sliding plate 11 of the seat supporting table 10, to which the barber or beauty chair 20 is attached, is slid to an appropriate position where the neck of the person to be washed can be appropriately received by the neck receiving part 4. Further, the sliding power controlling bolt 15 is loosened or tightened, thereby controlling the sliding power required for sliding the barber or beauty chair 20.

The control of the sliding power can be realized as follows. When the sliding power controlling bolt. 15 is loosened, power of pressing down the slider 16 to the sliding plate 17 is slightly weakened, thereby lowering frictional force between the slider 16 and the sliding plate 17. On the contrary, when the sliding power controlling bolt 15 is tightened, the frictional force between the slider 16 and the sliding plate 17 is increased.

As described above, according to the hair washer with the seat supporting table for the barber or beauty chair of the first embodiment, the barber or, beauty chair 20 is attached to the seat supporting table 10 which slides forward and backward, thereby sliding the barber or beauty chair, even when the seat of the barber or beauty chair is provided with no sliding function. Therefore, the person to be washed can be shampooed in a comfortable position, regardless of his height.

Further, the hair washer with the seat supporting table for a barber or beauty chair according to the first embodiment has a structure in which the engaging part 21 of the barber or beauty chair 20 is fixed with engaged with the attaching part 18 of the seat supporting table 10. Therefore, the barber or beauty chair 20 can be removed, thereby easily handling the dirtiness and the design change.

What is claimed is:

1. A hair washer comprises a ball part provided with a neck receiving part for receiving a neck part of a person to be washed, a leg part for supporting the ball part, and a seat supporting table supporting arm, one end of which is fixed to the leg part, and the other end of which is provided with a seat supporting table, to which a barber or beauty chair can be detachably attached, wherein.

the seat supporting table is provided with a sliding part which slides forward and backward, and the sliding part is provided with an attaching part for attaching the barber or beauty chair.

2. The hair washer with the seat supporting table for a barber or beauty chair described in claim 1, wherein the sliding part is slid to a desired position along a guide rail for guiding a slide of the sliding part, and comprises a sliding power controlling part for controlling sliding power required for sliding the sliding part.

3. The hair washer with a seat supporting table for the barber or beauty chair described in claim 1, wherein the attaching part for attaching the barber or beauty chair is a projection to be engaged with an engaging part provided on a rear face of the barber or beauty chair.

* * * * *

UNITED STATES PATENT AND TRADEMARK OFFICE

CERTIFICATE OF CORRECTION

PATENT NO. : 6,434,763 B2
APPLICATION NO. : 09/901359
DATED : August 20, 2002
INVENTOR(S) : Toshiaki Kawakami It is certified that error appears in the above-identified patent and that said Letters Patent is hereby corrected as shown below:

Title Page, item Col. 2

(56) References Cited

U.S. PATENT DOCUMENTS

After the last Cited Reference "6,230,345 B1 * 5/2001 Borrero et al." Please insert --FOREIGN PATENT DOCUMENTS

DE 3522110 A1 6/1985--

Signed and Sealed this

Eleventh Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 6,434,763 B2
APPLICATION NO. : 09/901359
DATED : August 20, 2002
INVENTOR(S) : Toshiaki Kawakami It is certified that error appears in the above-identified patent and that said Letters Patent is hereby corrected as shown below:

This certificate supersedes the Certificate of Correction issued December 11, 2007. The Certificate of Correction is to be vacated, since foreign patent document has not been considered by the examiner of record. Therefor

"FOREIGN PATENT DOCUMENTS

DE 3522110 A1 6/1985" is to be deleted.

Signed and Sealed this

Twenty-ninth Day of April, 2008

JON W. DUDAS
*Director of the United States Patent and Trademark Office*